US009752354B2

(12) United States Patent
Wang

(10) Patent No.: US 9,752,354 B2
(45) Date of Patent: Sep. 5, 2017

(54) CHAIN LOCK

(71) Applicant: SINOX CO., LTD, New Taipei (TW)

(72) Inventor: Chia-Hung Wang, New Taipei (TW)

(73) Assignee: SINOX CO., LTD, New Taipei (TW)

( * ) Notice: Subject to any disclaimer, the term of this patent is extended or adjusted under 35 U.S.C. 154(b) by 0 days.

(21) Appl. No.: 15/240,093

(22) Filed: Aug. 18, 2016

(65) Prior Publication Data

US 2017/0051537 A1 Feb. 23, 2017

(30) Foreign Application Priority Data

Aug. 18, 2015 (TW) ..... 104213311 U

(51) Int. Cl.
*E05B 67/00* (2006.01)
*E05B 37/02* (2006.01)

(52) U.S. Cl.
CPC ..... *E05B 67/003* (2013.01); *E05B 37/025* (2013.01)

(58) Field of Classification Search
CPC ..... E05B 37/08; E05B 47/0004; E05B 5/003; E05B 37/00; E05B 37/02; E05B 67/003; E05B 67/28; E05B 63/0017; E05B 37/0031; E05B 37/0068; Y10T 70/5872; Y10T 70/40; Y10T 70/435; Y10T 70/483; Y10T 70/5531
USPC ..... 70/14, 30, 49, 58, DIG. 20
See application file for complete search history.

(56) References Cited

U.S. PATENT DOCUMENTS 1,369,308 A * 2/1921 Taylor ..... B60R 25/007 188/31
1,718,723 A * 6/1929 Williams ..... E05B 67/24 70/18
3,382,688 A * 5/1968 Wellekens ..... E05B 5/003 70/208
5,913,906 A * 6/1999 Strocchi ..... B62H 5/003 59/78
6,098,434 A * 8/2000 Liou ..... B60R 25/086 70/360
6,386,005 B1 * 5/2002 Kuo ..... E05B 37/025 70/28
6,711,921 B1 * 3/2004 Yang ..... E05B 73/0082 248/551
6,799,446 B1 * 10/2004 Tsai ..... E05B 37/02 70/26
6,820,448 B1 * 11/2004 Hsieh ..... E05B 67/003 70/18

(Continued)

FOREIGN PATENT DOCUMENTS

TW M350495 U 2/2009

*Primary Examiner* — Suzanne Barrett
(74) *Attorney, Agent, or Firm* — Innovation Capital Law Group, LLP; Vic Lin

(57) ABSTRACT

The chain lock of the present invention includes a lock body and a linkage chain. The lock body has a combination lock core and a socket, wherein the combination lock core has a plurality of discs. The linkage chain is formed via linking a plurality of link plates and has a first end portion and a second end portion, wherein the first end portion is joined with the lock body. The second end portion can be inserted into and secured to the socket. The combination lock core locks the second end portion when the second end portion has been inserted into the socket The linkage chain can be wound around the lock body when the second end portion is unlocked.

10 Claims, 6 Drawing Sheets

(56) References Cited

U.S. PATENT DOCUMENTS

| | | | | |
|---|---|---|---|---|
| 7,185,518 | B1 * | 3/2007 | Huang | E05B 73/0082 70/14 |
| 7,249,475 | B2 * | 7/2007 | Yu | E05B 37/025 24/598.1 |
| 7,437,898 | B2 * | 10/2008 | Su | E05B 67/003 70/14 |
| 7,481,084 | B1 * | 1/2009 | Wu | E05B 67/003 70/18 |
| 7,712,339 | B2 * | 5/2010 | Hentschel | E05B 37/025 70/14 |
| 8,302,436 | B2 * | 11/2012 | Cheung | E05B 67/003 70/14 |
| 8,555,682 | B2 * | 10/2013 | Trunek | B62H 5/003 70/14 |
| 8,621,898 | B2 * | 1/2014 | Chen | E05B 67/003 70/18 |
| 8,881,559 | B1 * | 11/2014 | Chang | E05B 67/003 70/14 |
| 8,904,831 | B2 * | 12/2014 | Stevens | E05B 73/00 70/14 |
| 9,217,265 | B2 * | 12/2015 | Muller | E05B 71/00 |
| 9,341,004 | B2 * | 5/2016 | Elson | B62H 5/00 |
| 2005/0044903 | A1 * | 3/2005 | Ling | E05B 67/003 70/30 |

* cited by examiner

CHAIN LOCK

BACKGROUND OF THE INVENTION

1. Field of the Invention

The present invention relates to a chain lock comprising a lock body and a linkage chain wound around the lock body to reduce the volume of the lock.

2. Description of the Prior Art

An U.S. Pat. No. 7,712,339 disclosed a joint rod lock, which comprises a lock body and a joint bar hoop formed via linking a plurality of bars, and which can be folded together to reduce the volume thereof when collected. A Taiwan patent No. M350495 also disclosed a similar lock.

Compared with the conventional U-shape padlocks having a bulky volume, the abovementioned linkage locks indeed have reduced size. However, the abovementioned prior arts still have room to improve. For example, the appearance of the collapsed locks should be taken in consideration in design in addition to volume reduction.

SUMMARY OF THE INVENTION

An object of the present invention is to provide an improved chain lock which has reduced volume.

The chain lock of the present invention includes a lock body and a linkage chain. The lock body has a combination lock core and a socket, wherein the combination lock core has a plurality of discs. The linkage chain is formed via linking a plurality of link plates and has a first end portion and a second end portion, wherein the first end portion is joined with the lock body. The second end portion can be inserted into and secured to the socket. The combination lock core locks the second end portion when the second end portion has been inserted into the socket The linkage chain can be wound around the lock body when the second end portion is unlocked.

The socket is disposed on a side face of the lock body, wherein the plurality of discs are exposed on the side face in a position other than the socket. The combination lock core has a latch, wherein the second end portion has a positioning hole. After the second end portion has been inserted into the socket, the latch can be operated to pass through the positioning hole to prevent the second end portion from leaving the socket.

The latch is movable along a pivot direction of the lock body when the combination lock core is in a unlock state. The movement of the latch in the lock body is restricted when the combination lock core is in a lock state.

The lock body further has a cap. The latch extends out of a first end of the lock body and joins with the cap. The second end portion is able to leave the socket when the cap is in an unlock position away from the first end. The latch prevents the second end portion from leaving the socket when the cap is a lock position near the first end. The lock body further has an elastic unit disposed between the cap and the first end.

The link plates are pivotally linked. The link plates are pivotally linked one over one. The linkage chain covers the discs of the combination lock core when the linkage chain is wound around the lock body.

The lock body and the second end portion respectively have a positioning block and a positioning hole. When the linkage chain has been wound around the lock body, the positioning block engages with the positioning hole.

DETAILED DESCRIPTION OF THE PREFERRED EMBODIMENT

Figure 1:
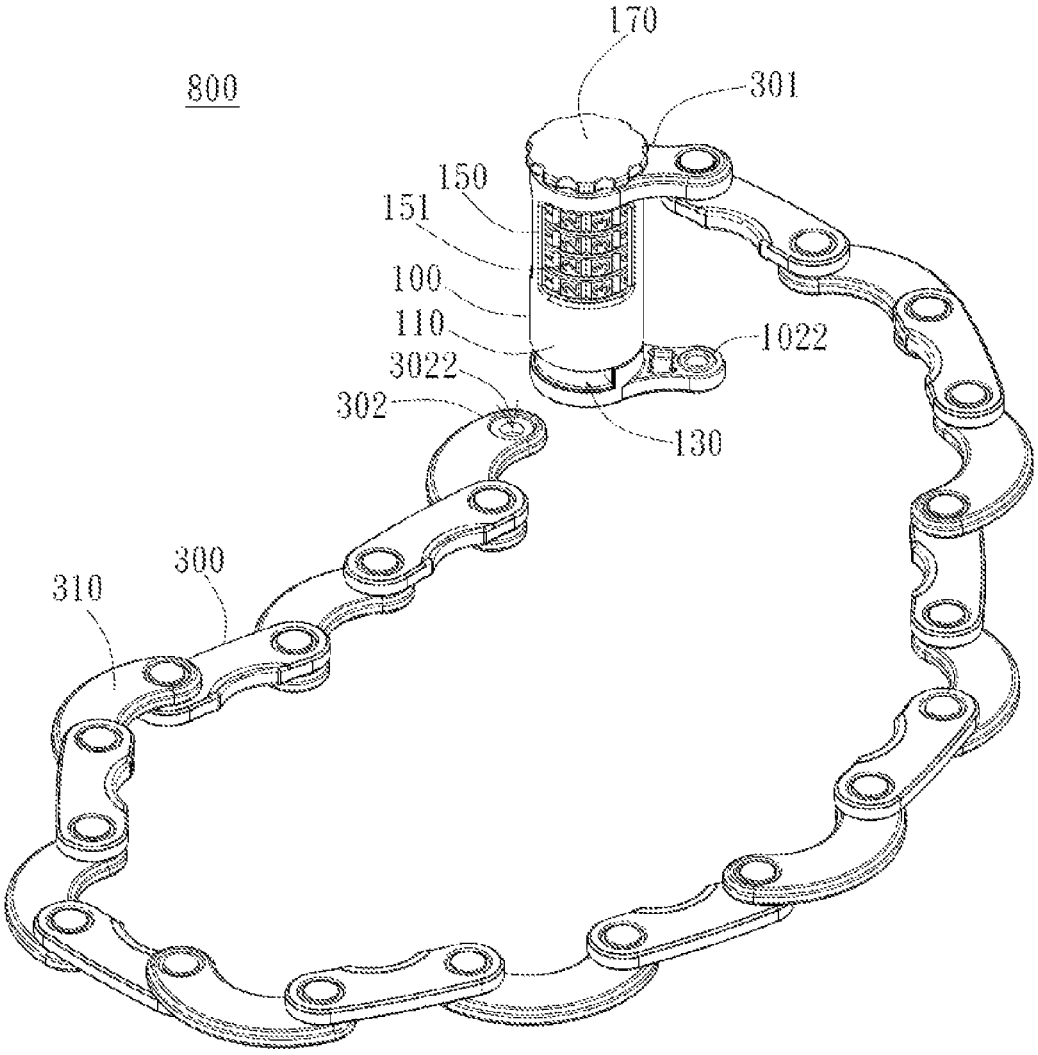
FIG. 1 is a perspective view schematically showing that an unfolded linkage chain has not been locked to a lock body according to one embodiment of the present invention.
Figure 2:
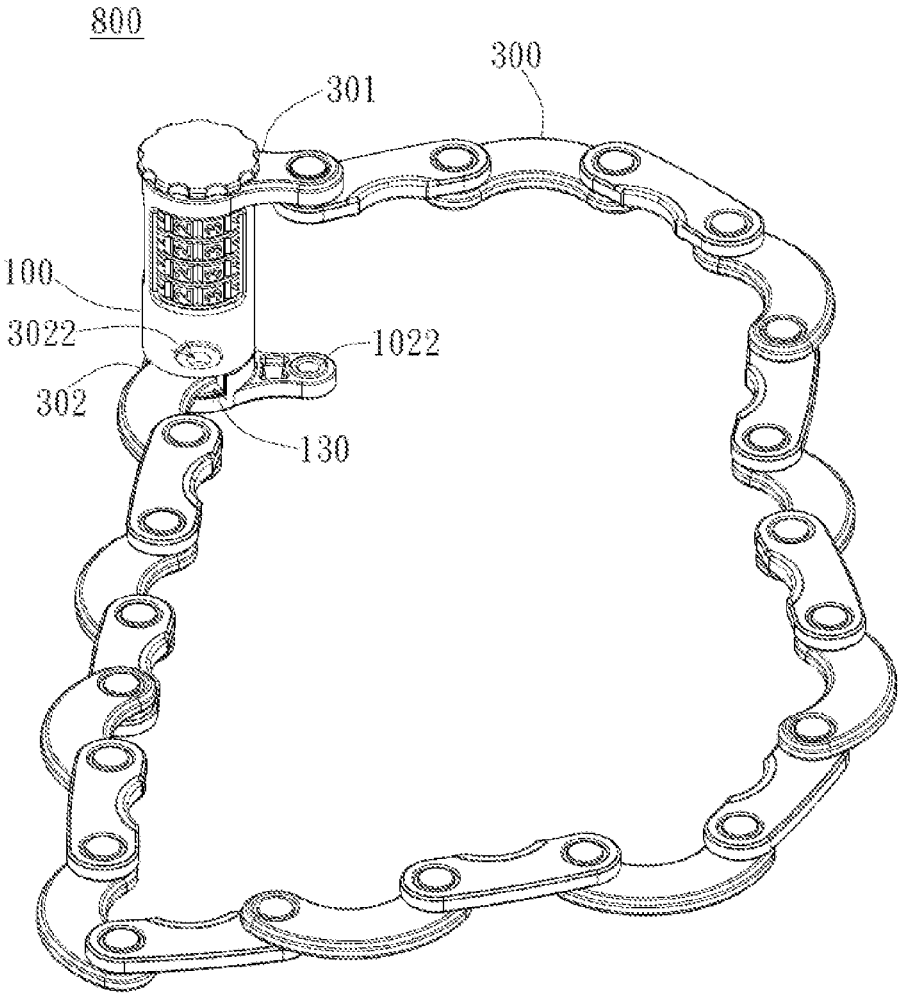
FIG. 2 is a perspective view schematically showing that a linkage chain has been locked to a lock body according to one embodiment of the present invention.

As the embodiments shown in FIG. 1, the chain lock 800 of the present invention includes a lock body 100 and a linkage chain 300. The lock body has a combination lock core 150 and a socket 130, wherein the combination lock core 150 has a plurality of discs 151. In one embodiment, the socket 130 is disposed on a side face 110 of the lock body 100, wherein the plurality of discs 151 are exposed on the side face 110 in a position other than the socket 130. In different embodiments, however, with the consideration of manufacturing and design requirement, the socket 130 is not limited to be disposed on the side face 110 of the lock body 100, wherein the plurality of discs 151 are not limited to be exposed on the side face 110 in the position other than the socket 130. The linkage chain 300 is formed via linking a plurality of link plates 310 and has a first end portion 301 and a second end portion 302, wherein the first end portion 301 is joined with the lock body 100. As the embodiment shown in FIG. 2, the second end portion 302 can be inserted into and secured to the socket 130. The combination lock core 150 locks the second end portion 302 when the second end portion 302 has been inserted into the socket 130. On the other hand, as the embodiment shown in FIG. 3, when the second end portion 302 is unlocked, the linkage chain 300 can be wound around the lock body 100 to have a smaller size and present an exquisite appearance.

In the preferable embodiment, the link plates 310 are pivotally linked to form the linkage chain 300. The link plates 310 are pivotally linked one over one for the benefit of winding the linkage chain 300 around the lock body 100. Moreover, the linkage chain 300 preferably covers the discs 151 of the combination lock core 150 for protecting the discs 151 when the linkage chain 300 is wound around the lock body 100. The lock body 100 and the second end portion 302 of the linkage chain 300 respectively have a positioning block 1022 and a positioning hole 3022. When the linkage chain 300 has been wound around the lock body 100, the positioning block 1022 engages with the positioning hole 3022, whereby the second end portion 302 of the linkage chain 300 is secured to the lock body 100. Such a design can prevent the linkage chain 300 detaching from the lock body 100 and keep the folded linkage lock 300 having the appearance shown in FIG. 3.

Figure 4A:
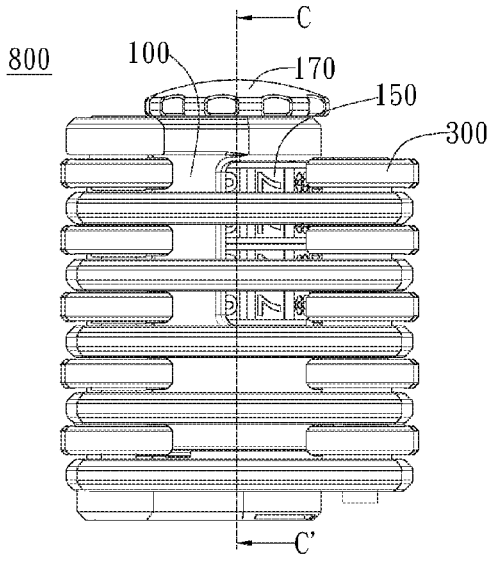
FIGS. 4A and 4B are perspective views schematically showing that a latch has passed through a positioning hole according to one embodiment of the present invention.
Figure 4B:
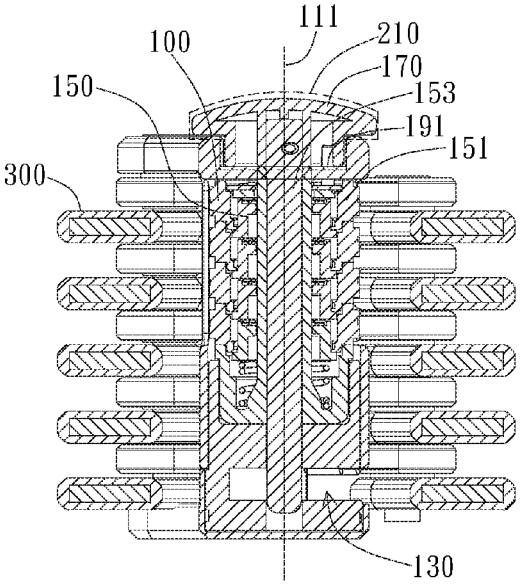

As the embodiments shown in FIG. 4A and FIG. 4B (which is the cross section view of CC' line in FIG. 4A), the combination lock core 150 has a latch 153. When the combination lock core 150 is in a unlock state, e.g. the disc 151 are with a correct sequence of numbers, the latch 153 is movable in the lock body 100 along a pivot direction 111 of the lock body 100. The movement of the latch 153 in the lock body 100 is restricted when the combination lock core 150 is in a lock state. Various technologies associated with the combination lock core are been known, so detailed description thereof will be omitted. On the other hand, as the embodiment shown in FIG. 1, the second end portion 302 has a positioning hole 3022. Accordingly, after the second end portion 302 has been inserted into the socket 130, the combination lock core 150 can be operated to pass through the positioning hole 3022 via the latch 153 to prevent the second end portion 302 from leaving the socket 130 and hence lock the chain lock 800.

Figure 5A:
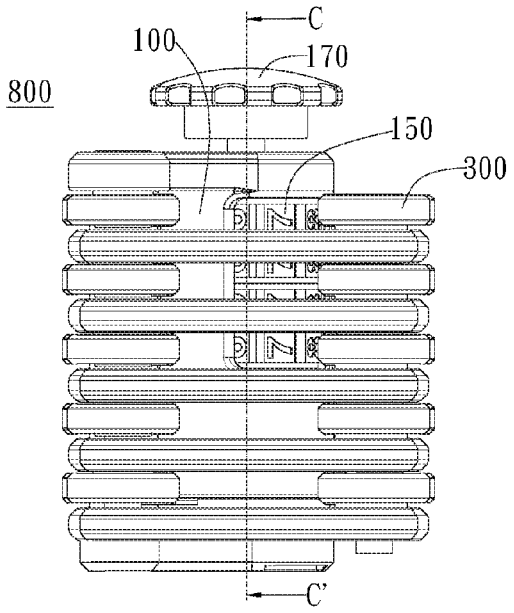
FIGS. 5A and 5B are perspective views schematically showing that a latch has left a positioning hole according to one embodiment of the present invention.
Figure 5B:
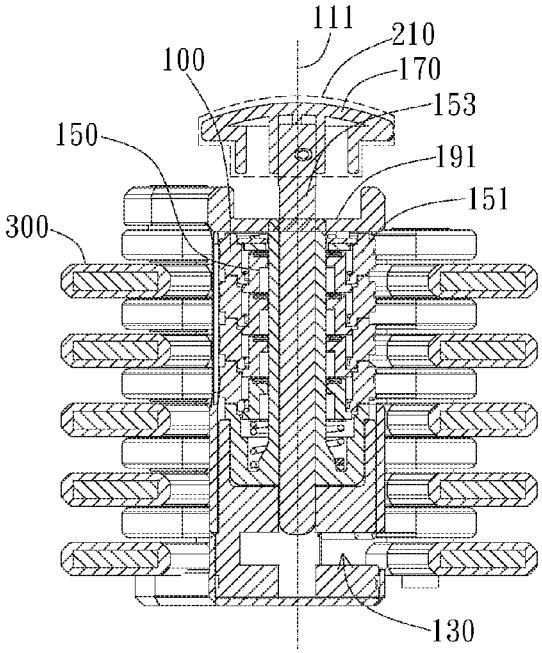

As the embodiments shown in FIGS. 4A and 4B, the lock body 100 further has a cap 170. The latch 153 extends out of a first end 191 of the lock body 100 and joins with the cap 170. When the cap is in a lock position 210 near the first end 191, the opposite end of the latch 153 with respect to the cap 170 enters into the socket 130. Accordingly, the latch 153 prevents the second end portion 302 (see FIGS. 1 and 2) from entering or leaving the socket 130. On the other hand, as the embodiments shown in FIG. 5A and FIG. 5B (which is the cross section view of CC' line in FIG. 5A), when the cap 170 is in an unlock position 220 away from the first end 191 and physically separated from the outermost top portion of the lock body 100, the opposite end of the latch 153 with respect to the cap 170 doesn't enter into the socket 130. Accordingly, the second end portion 302 is able to enter or leave the socket 130.

Figure 3:
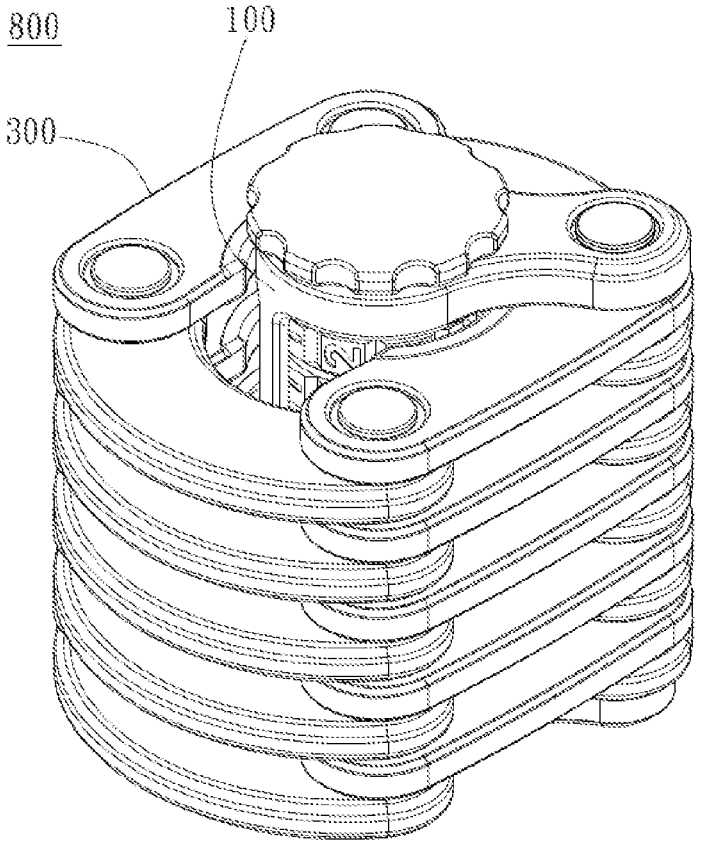
FIG. 3 is a perspective view schematically showing that a linkage chain has been wound around a lock body according to one embodiment of the present invention.

More particularly, in an embodiment, a user takes the chain 800 having the combination lock core 150 in the lock state and the linkage chain 300 wound around the lock body 100 as shown in FIG. 3. The user unfolds linkage chain 300 as shown in FIG. 1 and stretches it in to an object to be locked (e.g. a wheel rim of a bike). Then the user pulls the cap 170 to the unlock position 220 away from the first end 191 to make the opposite end of the latch 153 with respect to the cap 170 not enter into the socket 130 and inserts the second end portion 302 into the socket 130. After that, the user pushes the cap 170 to the lock position 210 near the first end 191 to make the opposite end of the latch 153 with respect to the cap 170 enter into the positioning hole 3022 of the second end portion 302 in the socket 130 and dial the discs 151 to be not with the correct sequence of numbers. Thus, the latch 153 is able to prevent the second end portion 302 from leaving the socket 130, wherein the object is locked. To unlock the object, the user can dial the discs 151 to be with the correct sequence of numbers to relieve the restriction of the movement of the latch 153. Thus, the opposite end of the latch 153 with respect to the cap 170 is able to leave the positioning hole 3022, wherein the second end portion 302 is able to leave the socket 130. The object is unlocked.

Figure 6:
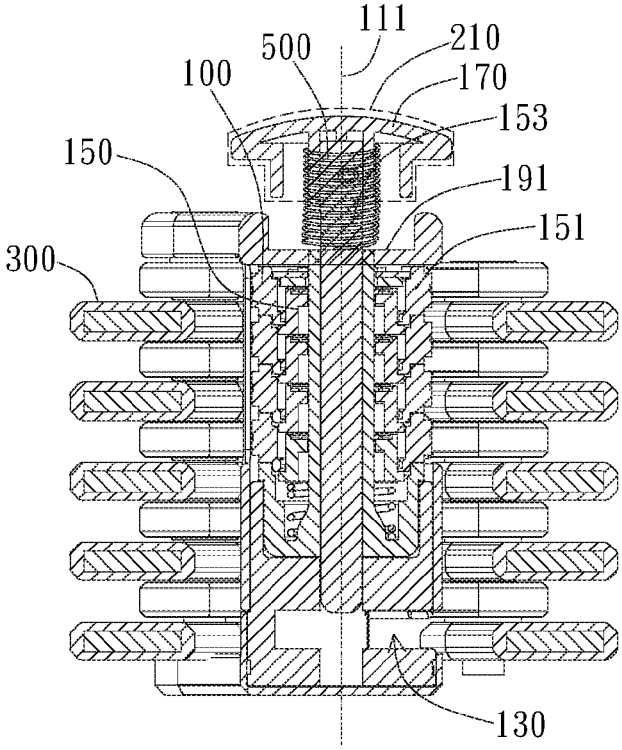
FIG. 6 is a perspective view schematically showing that a chain lock comprising an elastic unit according to one embodiment of the present invention.

As the embodiment shown in FIG. 6, the lock body 100 further has an elastic unit 500 disposed between the cap 170 and the first end 191. When the discs 151 are dialed to be with the correct sequence of numbers to relieve the restriction of the movement of the latch 153, the cap 170 leaps to the unlock position away from the first end 191 and physically separated from the outermost top portion of the lock body 100 by the elastic force of the elastic unit 500. Thus, the handiness and the friendliness of the chain lock to the user are increased.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A chain lock, comprising:

a lock body having a combination lock core and a socket, wherein the combination lock core has a plurality of discs;

a linkage chain formed via linking a plurality of link plates and having a first end portion and a second end portion, wherein the first end portion is joined with the lock body, wherein the second end portion can be inserted into and secured to the socket, wherein the second end portion has a positioning hole, wherein the combination lock core locks the second end portion when the second end portion has been inserted into the socket, wherein the socket is disposed on a side face of the lock body, wherein the plurality of discs are exposed on the side face in a position other than the socket, wherein the linkage chain can be wound around the lock body when the second end portion is unlocked;

a latch having a latch first end and a latch second end opposite the latch first end; and a cap attached to the latch second end, wherein the latch second end extends out of a first end of the lock body to join with the cap, wherein the second end portion of the linkage chain is secured by the latch first end when inserted into the socket with the cap in a lock position near the first end of the lock body as well as the latch first end passing through the positioning hole, wherein the second end portion of the linkage chain is able to leave the socket when the cap is in an unlock position and physically separated from the outermost top portion of the lock body as well as the latch first end not entering into the socket.

2. The chain lock of claim 1 wherein the second end portion has a positioning hole, wherein after the second end portion has been inserted into the socket, the latch first end is operable to pass through the positioning hole to prevent the second end portion from leaving the socket.

3. The chain lock of claim 1, wherein the latch is movable along a pivot direction of the lock body when the combination lock core is in an unlock state, wherein the movement of the latch in the lock body is restricted when the combination lock core is in a lock state.

4. The chain lock of claim 1, wherein the lock body further has an elastic unit disposed between the cap and the first end.

5. The chain lock of claim 1, wherein the link plates are pivotally linked.

6. The chain lock of claim 5, wherein the link plates are pivotally linked one over one.

7. The chain lock of claim 1, wherein the lock body and the second end portion respectively have a positioning block and a positioning hole, wherein the positioning block engages with the positioning hole when the linkage chain has been wound around the lock body.

8. A chain lock, comprising:

a lock body having a combination lock core and a socket, wherein the combination lock core has a plurality of discs;

a linkage chain formed via linking a plurality of link plates and having a first end portion and a second end portion, wherein the first end portion is joined with the lock body, wherein the second end portion can be inserted into and secured to the socket, wherein the second end portion has a positioning hole, wherein the combination lock core locks the second end portion when the second end portion has been inserted into the socket, wherein the plurality of discs are exposed on the side face in a position other than the socket, wherein the linkage chain can be wound around the lock body when the second end portion is unlocked;

a latch having a latch first end and a latch second end opposite the latch first end;

a cap attached to the latch second end, wherein the latch second end extends out of a first end of the lock body to join with the cap, wherein the second end portion of the linkage chain is secured by the latch first end when inserted into the socket with the cap in a lock position near the first end of the lock body as well as the latch first end passing through the positioning hole, wherein the second end portion of the linkage chain is able to leave the socket when the cap is in an unlock position and physically separated from the outermost top portion of the lock body as well as the latch first end not entering into the socket; and an elastic unit disposed between the cap and the first end, the elastic unit disposed surrounding the latch.

9. The chain lock of claim 8, wherein the second end portion has a positioning hole, wherein after the second end portion has been inserted into the socket, the latch first end is operable to pass through the positioning hole to prevent the second end portion from leaving the socket.

10. The chain lock of claim 8, wherein the latch is movable along a pivot direction of the lock body when the combination lock core is in an unlock state, wherein the movement of the latch in the lock body is restricted when the combination lock core is in a lock state.

* * * * *